US010784594B2

(12) United States Patent
Zhang

(10) Patent No.: US 10,784,594 B2
(45) Date of Patent: Sep. 22, 2020

(54) ADAPTER CONNECTOR

(71) Applicant: LOTES CO., LTD, Keelung (TW)

(72) Inventor: Wen Kuan Zhang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/363,096

(22) Filed: Mar. 25, 2019

(65) Prior Publication Data

US 2019/0296452 A1 Sep. 26, 2019

(30) Foreign Application Priority Data

Mar. 26, 2018 (CN) ..... 2018 1 0251292

(51) Int. Cl.
*H01R 4/70* (2006.01)
*H01R 4/18* (2006.01)
*H01R 13/426* (2006.01)

(52) U.S. Cl.
CPC ..... *H01R 4/185* (2013.01); *H01R 4/70* (2013.01); *H01R 13/426* (2013.01)

(58) Field of Classification Search
CPC .... H01R 13/11; H01R 13/187; H01R 13/432; H01R 13/52; H01R 13/74; H01R 13/35; H01R 13/04; H01R 31/06; H01R 4/20; H01R 4/188; H01R 25/03
USPC ..... 439/879, 891, 654, 638
See application file for complete search history.

(56) References Cited

U.S. PATENT DOCUMENTS 4,834,673 A * 5/1989 Beinhaur ..... H01R 12/675 439/422
5,161,990 A * 11/1992 Ling ..... H01R 27/00 439/173
5,271,741 A * 12/1993 Saito ..... H01R 13/187 439/843
5,338,229 A * 8/1994 Egenolf ..... H01R 13/18 439/839

(Continued)

FOREIGN PATENT DOCUMENTS

CN 2567812 Y 8/2003
CN 2772071 Y 4/2006

(Continued)

*Primary Examiner* — Edwin A. Leon
*Assistant Examiner* — Milagros Jeancharles
(74) *Attorney, Agent, or Firm* — Locke Lord LLP; Tim Tingkang Xia, Esq.

(57) ABSTRACT

An adapter connector has two ends to be mated with a first mating connector and a second mating connector respectively. The adapter connector includes an insulating body and multiple terminals. The insulating body has a first mating section and a second mating section. The first mating section is concavely provided with multiple terminal slots. The second mating section is concavely provided with an insertion space communicated with the terminal slots. The first mating section is mated with the first mating connector. The insertion space accommodates the second mating connector. Each terminal has an elastic contact portion at one end thereof and a flat plate contact portion at the other end thereof. The elastic contact portion is accommodated in a corresponding terminal slot and electrically connected with the first mating connector. The flat plate contact portion is accommodated in the insertion space to be electrically connected with the second mating connector.

18 Claims, 10 Drawing Sheets

(56) References Cited

U.S. PATENT DOCUMENTS 5,549,480 A * 8/1996 Cheng ..... H01R 13/631 439/79
5,716,244 A * 2/1998 Egenolf ..... H01R 13/18 439/843
6,102,739 A * 8/2000 Murakami ..... F16H 61/0006 439/587
6,375,492 B1 * 4/2002 Hio ..... H01R 12/68 439/422
6,955,567 B2 * 10/2005 Inaba ..... H01R 13/432 439/651
7,442,097 B2 * 10/2008 Kumakura ..... H01R 43/16 439/866
7,445,523 B2 11/2008 Onoda et al.
7,976,353 B2 * 7/2011 Myer ..... H01R 13/04 439/891
8,911,269 B2 * 12/2014 Takayama ..... H01R 4/203 439/421
8,998,659 B2 * 4/2015 Sato ..... H01R 4/185 439/606
9,252,526 B2 * 2/2016 Cho ..... H01R 13/5216
9,281,574 B2 * 3/2016 Kawamura ..... H01R 43/005
9,525,215 B2 * 12/2016 Kawamura ..... H01R 4/18
2007/0049132 A1 * 3/2007 Uchida ..... H01R 13/113 439/891
2007/0270050 A1 * 11/2007 Anbo ..... H01R 13/11 439/879
2011/0083324 A1 4/2011 Martauz et al.

FOREIGN PATENT DOCUMENTS

CN 100470950 C 3/2009
CN 100474703 C 4/2009
CN 101453072 A 6/2009
CN 202616511 U 12/2012
CN 106068585 A 11/2016
CN 107275841 A 10/2017
CN 106602307 B 2/2019
JP H0845627 A 2/1996
JP 2004253163 A 9/2004

* cited by examiner

ADAPTER CONNECTOR

CROSS-REFERENCE TO RELATED PATENT APPLICATION

This non-provisional application claims priority to and the benefit of, pursuant to 35 U.S.C. § 119(a), patent application Serial No. CN201810251292.4 filed in China on Mar. 26, 2018. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an adapter connector, and more particularly to an adapter connector capable of converting two different series of connectors.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

With the development of society and the growth in living standards of people, private cars owned by each family are increasing. Thus, car after-sale services grow increasingly, and modification of car headlights is an important field. Common car headlights include various different series in different specifications. Therefore, a series of headlights cannot match with another series of headlights. For example, receptacles of a 9006 series can only match with plugs of the 9006 series, and receptacles of an h11 series can only match with plugs of the h11 series. However, during modification of the headlights, a consumer generally selects headlights preferably according to performances or personal preferences. Thus, the selected headlights and an own car may be in different series. Because each car is equipped with fixed headlight receptacles, and each series of headlights has uniquely matching plugs and receptacles, it is necessary to replace original receptacles of a car during replacement of other series of headlights, which is inconvenient in operation, and increases the modification cost.

Therefore, a heretofore unaddressed need to design a novel adapter connector exists in the art to address the aforementioned deficiencies and inadequacies.

SUMMARY

The present invention is directed to an adapter connector capable of converting two different series of connectors.

To achieve the foregoing objective, the present invention adopts the following technical solutions.

An adapter connector has two ends configured to be mated with a first mating connector and a second mating connector respectively. The adapter connector includes: an insulating body being integrally formed, the insulating body having a first mating section and a second mating section in a front-rear direction, wherein the first mating section is concavely provided with a plurality of terminal slots, the second mating section is concavely provided with an insertion space, the terminal slots are communicated with the insertion space, the first mating section is mated with the first mating connector, and the insertion space accommodates the second mating connector; and a plurality of terminals, each of the terminals having an elastic contact portion at one end thereof and a flat plate contact portion at the other end thereof, wherein the elastic contact portion is accommodated in a corresponding one of the terminal slots and electrically connected with the first mating connector, and the flat plate contact portion is accommodated in the insertion space and configured to be electrically connected with the second mating connector.

In certain embodiments, a top wall and a bottom wall opposite to each other and a first side wall and a second side wall being connected with the top wall and opposite to each other are provided on each of the terminals, the top wall, the bottom wall, the first side wall and the second side wall surroundingly define an insertion opening, and the elastic contact portion of each of the terminals bends backward from the first side wall to extend into the insertion opening.

In certain embodiments, the bottom wall has a first stopping sheet extending into the insertion opening, the top wall has a second stopping sheet extending into the insertion opening, the elastic contact portion is located closer to the second side wall relatively than the first stopping sheet and the second stopping sheet, and the first stopping sheet and the second stopping sheet stop the elastic contact portion from moving away from the second side wall.

In certain embodiments, a projection of at least one of the first stopping sheet and the second stopping sheet in the front-rear direction is located between a projection of the elastic contact portion and a projection of the flat plate contact portion in the front-rear direction.

In certain embodiments, each of the terminal slots has a first inner wall surface corresponding to the first side wall and a second inner wall surface corresponding to the second side wall, the first inner wall surface has a first stopping portion extending inward, the second inner wall surface has a second stopping portion extending inward, the second stopping portion is located behind the first stopping portion, the second side wall has a first position limiting portion, the first side wall has a second position limiting portion extending toward a direction away from the insertion opening, the first stopping portion is mated with the first position limiting portion, and the second stopping portion is mated with the second position limiting portion.

In certain embodiments, the first stopping portion is located in front of the first position limiting portion, and the second stopping portion is located behind the second position limiting portion.

In certain embodiments, an insulating member is accommodated in the insulating body, the insulating member has a third stopping portion, a third position limiting portion extends from the bottom wall, and the third stopping portion is mated with the third position limiting portion and located behind the third position limiting portion.

In certain embodiments, a projection of the third position limiting portion and a projection of the second side wall are partially overlapped in the front-rear direction.

In certain embodiments, the bottom wall has a first reinforcing portion located behind the insertion opening, and the first reinforcing portion further comprises a first opening hole.

In certain embodiments, the insertion space is further provided with an accommodating area extending forward, an insulating member is accommodated in the accommodating area, each of two opposite sides of the insulating member is provided with an engagement block, the engagement block is engaged with a front end surface of the accommodating area, the insulating member is provided with a plurality of grooves corresponding to the terminal slots, and each of the flat plate contact portions penetrates through each of the grooves and enters the insertion space.

In certain embodiments, each of the terminals further has an oblique section provided in front of the flat plate contact portion, and the insulating member has a plurality of guide chamfers corresponding to the oblique sections of the terminals, and each of the guide chamfers is in front of a corresponding one of the grooves.

In certain embodiments, an inner surface of the accommodating area has a horizontal section and a plastic reducing section provided sequentially in the front-rear direction, and the insulating member abuts the horizontal section to form a gap between the insulating member and the plastic reducing section.

In certain embodiments, each of the terminal slots accommodates a corresponding one of the terminals, and the insertion space accommodates the terminals.

Further, another adapter connector is provided, which has a front end and a rear end, the front end of the adapter connector being configured to be mated with a 9006 connector, and the rear end of the adapter connector being configured to be mated with an h11 connector. The adapter connector includes: an insulating body being provided with a first mating section and a second mating section in a front-rear direction, wherein the first mating section is concavely provided with a plurality of terminal slots, the second mating section is concavely provided with an insertion space, the terminal slots are communicated with the insertion space, the first mating section is mated with the 9006 connector, and the insertion space accommodates the h11 connector; and a plurality of terminals, each of the terminals being provided with a first contact portion at a front end thereof and a second contact portion at a rear end thereof, wherein the first contact portion is accommodated in a corresponding one of the terminal slots and electrically connected with the 9006 connector, and the second contact portion is accommodated in the insertion space and configured to be electrically connected with the h11 connector.

In certain embodiments, an intermediate portion is provided between the first mating section and the second mating section, the intermediate portion has at least one buckling arm extending from an outer surface of the intermediate portion to be above the first mating section and not to pass beyond a front end of the first mating section, an outer wall surface of the second mating section has at least one protruding block, and the 9006 connector and the h11 connector are mated with the buckling arm and the protruding block respectively.

In certain embodiments, a waterproof ring is sleeved over the first mating section, and the waterproof ring is located between the first mating section and the buckling arm.

Meanwhile, an adapter connector is provided, configured to be mated with a first mating connector and a second mating connector respectively. The adapter connector includes: a first body having a first mating section, wherein the first mating section is concavely provided with a plurality of terminal slots, and the first mating section is mated with the first mating connector; a second body, wherein a front end of the second body covers a periphery of a rear end of the first body, and a rear end of the second body is forward concavely provided with an insertion space configured to accommodate the second mating connector; and a plurality of terminals, each of the terminals comprising a first contact member and a second contact member, wherein the first contact member is accommodated in a corresponding one of the terminal slots, the first contact member has a first contact portion and a first connecting portion connected with each other and provided sequentially in a front-rear direction, the first contact portion is electrically connected with the first mating connector, the second contact member has a second contact portion and a second connecting portion connected with each other, the second contact portion is accommodated in the insertion space, the second contact portion is electrically connected with the second mating connector, and the second connecting portion enters the corresponding one of the terminal slots and abuts the first connecting portion.

In certain embodiments, a front end of the second body has an accommodating space communicated with the insertion space, and the second connecting portion and the rear end of the first body are accommodated in the accommodating space.

In certain embodiments, at least one protrusion is provided on the first connecting portion or the second connecting portion, and the first connecting portion and the second connecting portion are electrically connected via the protrusion.

In certain embodiments, the first connecting portion has a first portion and a second portion opposite to each other and two third portions connected with the first portion, the first portion and the two third portions surroundingly define a receiving opening, an elastic resisting sheet extends from the second portion into the receiving opening, the second connecting portion has a base and a bending arm extending forward from the base and bending reversely toward the base, the base abuts the elastic resisting sheet, and the bending arm abuts the top wall.

Compared with the related art, certain embodiments of the present invention have the following beneficial effects. During modification of car headlights, if the headlights in different series from original car headlights are selected, the headlights in different series can be converted only by the adapter connector without replacing original car headlight receptacles, such that a series of headlight plugs may easily match with another series of headlight receptacles, thereby providing an easy operation and saving time, and also reducing the modification cost.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
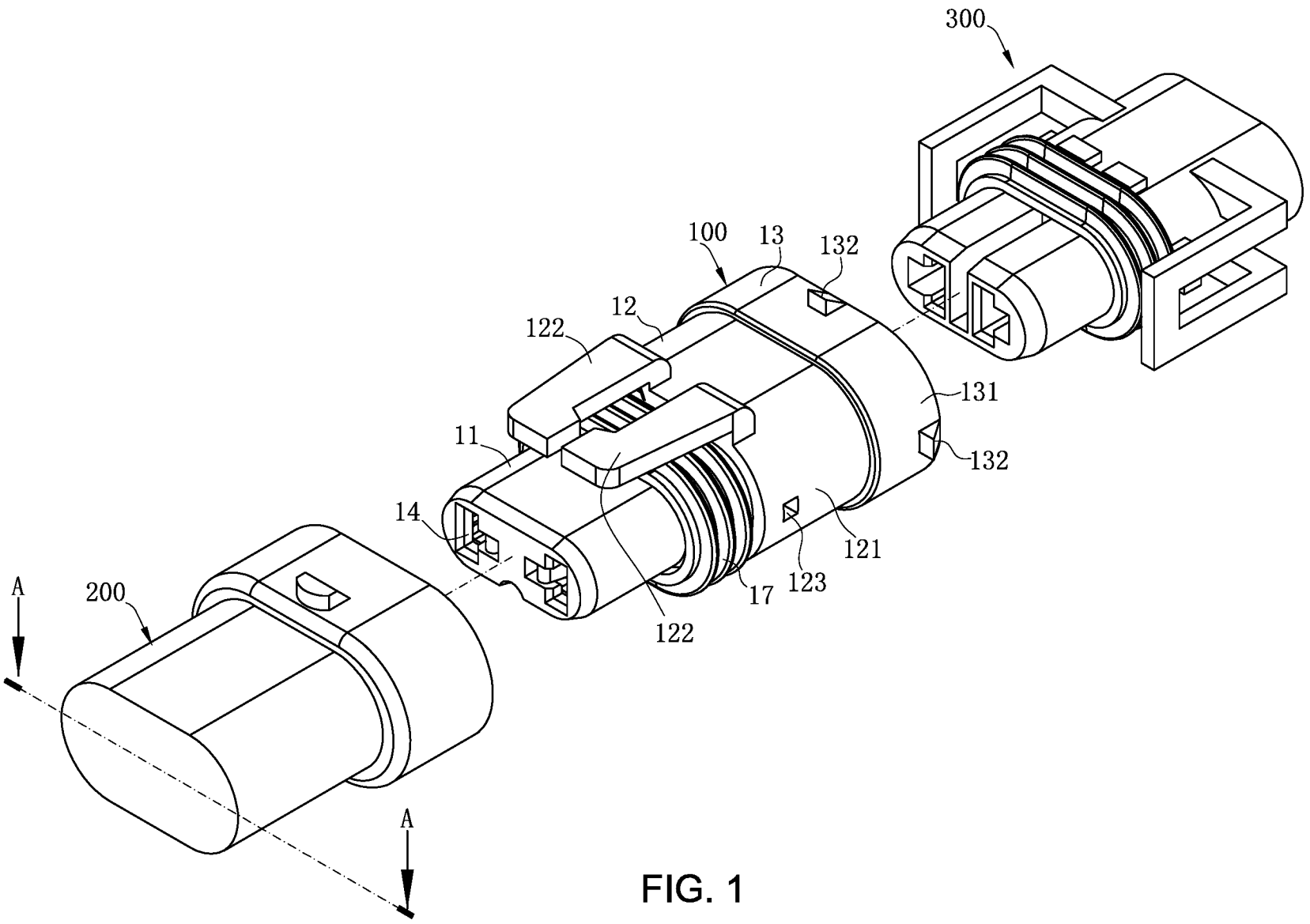
FIG. 1 is a perspective view of mating of an adapter connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated. As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-10. In accordance with the purposes of this invention, as embodied and broadly described herein, this invention, in one aspect, relates to an adapter connector.

Figure 2:
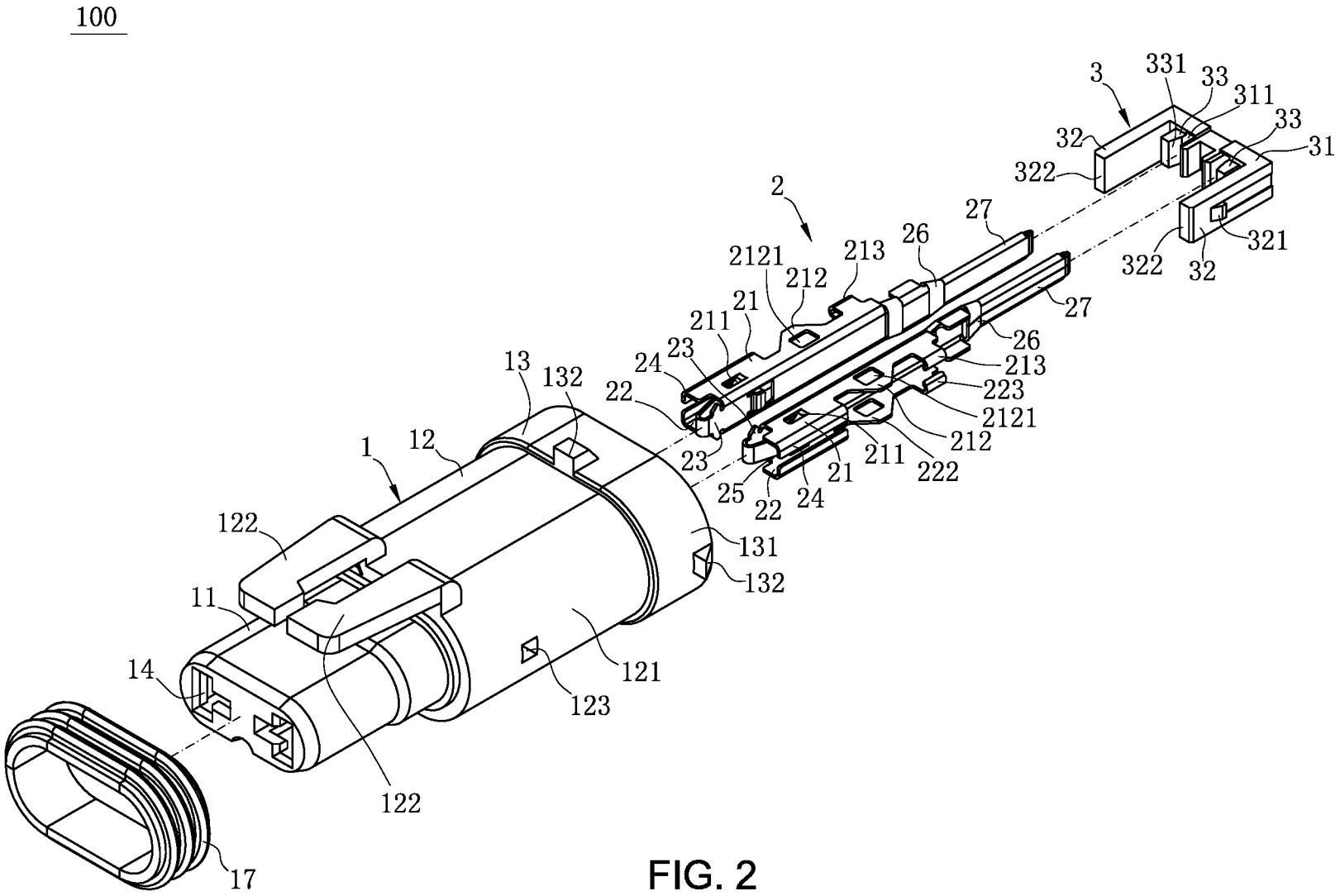
FIG. 2 is a perspective exploded view of an adapter connector according to the first embodiment of the present invention.
Figure 3:
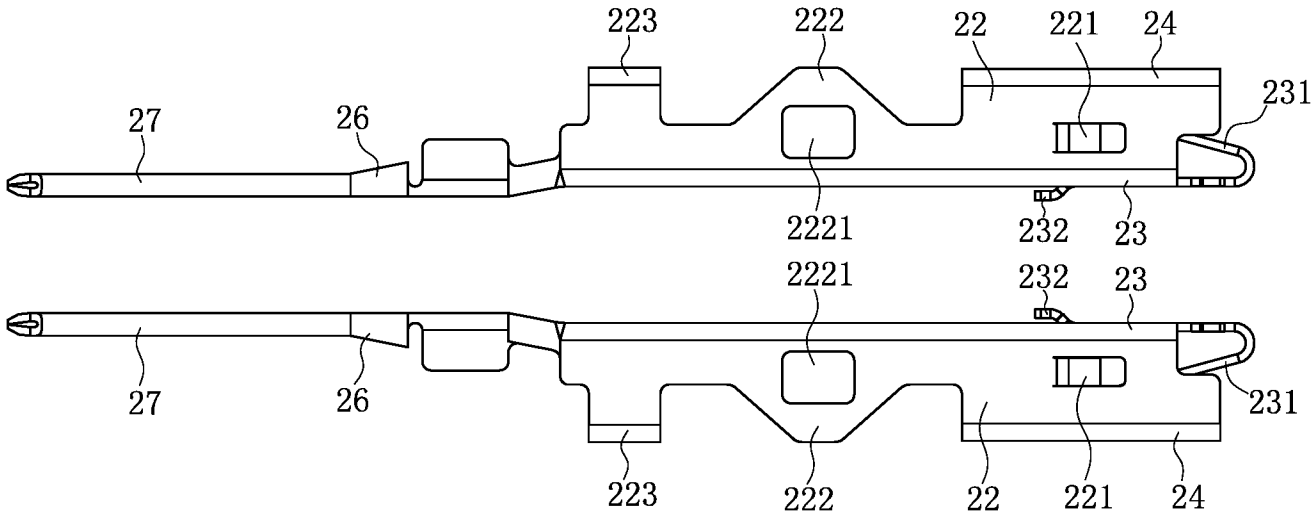
FIG. 3 is a bottom view of a terminal according to the first embodiment of the present invention.
Figure 4:
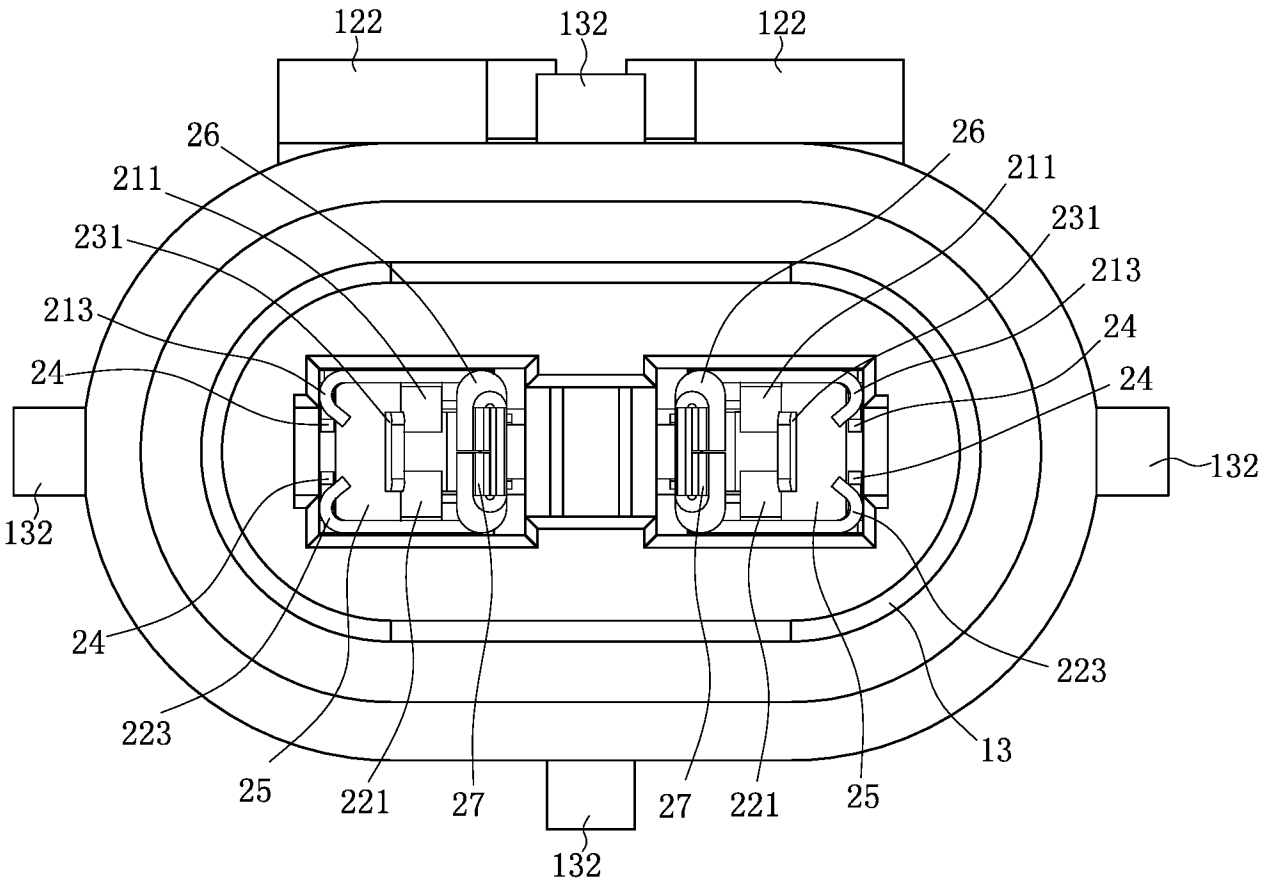
FIG. 4 is a rear view of the adapter connector in FIG. 2 before installing an insulating member.
Figure 5:
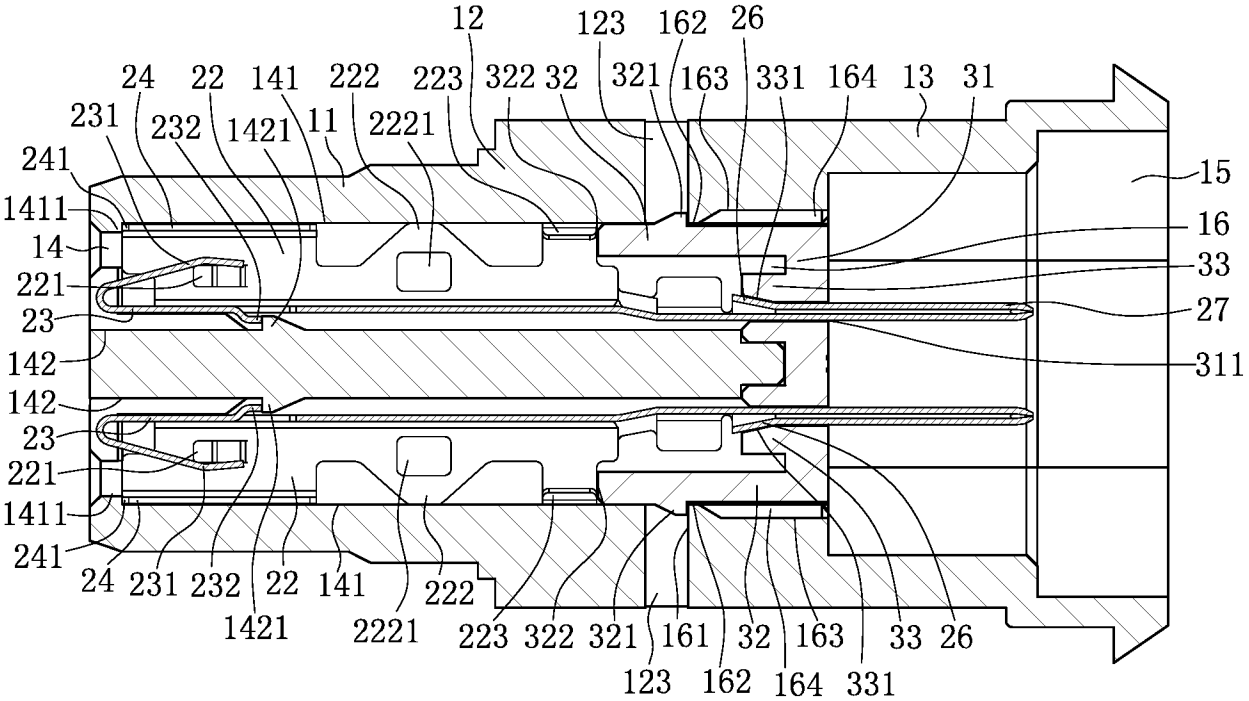
FIG. 5 is a sectional view of FIG. 1 along an A-A direction.

Referring to FIG. 1 to FIG. 5, which show an adapter connector 100 according to a first embodiment of the present invention. The adapter connector 100 is used to be connected with a first mating connector 200 and a second mating connector 300. In the present embodiment, the first mating connector 200 is a 9006 connector, and the second mating connector 300 is an h11 connector. The adapter connector 100 includes an insulating body 1, two terminals 2 and an insulating member 3. In the present embodiment, the adapter connector 100 is assembled by installing the terminals 2 into the insulating body 1 and then installing the insulating member 3 onto the insulating body 1. Referring to FIG. 1, FIG. 2 and FIG. 5, the insulating body 1 is an integrally formed structure, and is provided with a first mating section 11, an intermediate section 12 and a second mating section 13 in a front-rear direction. The first mating section 11 is used to be mated with the first mating connector 200, and the first mating section 11 is backward concavely provided with a plurality of terminal slots 14. The insulating member 3 is provided with a plurality of grooves 311 corresponding to the terminal slots 14. In the present embodiment, there are two terminal slots 14 in the insulating body 1, and correspondingly, there are two grooves 311 in the insulating member 3. An opening of each terminal slot 14 is T-shaped. Each terminal slot 14 has a first inner wall surface 141 and a second inner wall surface 142 opposite to each other. The first inner wall surface 141 has a first stopping portion 1411 extending into the terminal slot 14, and the second inner wall surface 142 has a second stopping portion 1421 extending into the terminal slot 14. The first stopping portion 1411 is located in front of the second stopping portion 1421, and the first stopping portion 1411 and the second stopping portion 1421 are located on different planes. The intermediate section 12 has an outer surface 121, which is concavely provided with two through holes 123. Two buckling arms 122 extend forward from the outer surface 121 to be above the first mating section 11 and not to pass beyond a front end of the first mating section 11. In the present embodiment, there are two buckling arms 122. In other embodiments, there may be one buckling arm. The buckling arms 122 are used to be mated with the first mating connector 200. The second mating section 13 is used to be mated with the second mating connector 300. An outer wall surface 131 of the second mating section 13 is provided with four protruding blocks 132. In the present embodiment, there are four protruding blocks 132. In other embodiments, there may be one protruding block. The protruding blocks 132 are used to be mated with the second mating connector 300 for fool proofing. Meanwhile, the second mating section 13 is forward concavely provided with an insertion space 15, and the insertion space 15 is communicated with the two terminal slots 14. When the adapter connector 100 is mated with the second mating connector 300, the insertion space 15 accommodates the second mating connector 300. The insertion space 15 is further formed with an accommodating area 16 extending forward. The accommodating area 16 has a front end surface 161. The accommodating area 16 communicates with the terminal slots 14 and the insertion space 15 and is located between the terminal slots 14 and the insertion space 15 in the front-rear direction. An inner surface of the accommodating area 16 are provided with a horizontal section 162 and a plastic reducing section 163 respectively. The front end surface 161, the horizontal section 162 and the plastic reducing section 163 are provided sequentially in the front-rear direction. Thus, the accommodating area 16 is gradually narrowed from rear to front. The adapter connector 100 further includes a waterproof ring 17, and the waterproof ring 17 is sleeved over the first mating section 11 and located between the buckling arms 122 and the first mating section 11.

Referring to FIG. 2 to FIG. 5, a top wall 21 and a bottom wall 22 opposite to each other and a first side wall 23 and a second side wall 24 being connected with the top wall 21 and opposite to each other are provided on each terminal 2. The top wall 21, the bottom wall 22, the first side wall 23 and the second side wall 24 surroundingly define a square-shaped insertion opening 25. The first side wall 23 of each of the terminals 2 has a first contact portion 231 bending backward from the first side wall 23 and extending into the insertion opening 25, and a second position limiting portion 232 extending from the first side wall 23 toward a direction away from the insertion opening 25. In the present embodiment, the first contact portion 231 is an elastic contact portion. Each first contact portion 231 is correspondingly accommodated in a corresponding terminal slot 14. The first contact portion 231 is used to be electrically connected with the first mating connector 200. The second position limiting portion 232 is mated with the second stopping portion 1421, and the second position limiting portion 232 is located in front of the second stopping portion 1421. The second side wall 24 is partitioned into two portions by a clearance. A front end of the second side wall 24 is provided with a first position limiting portion 241. The first position limiting portion 241 is mated with the first stopping portion 1411, and the first position limiting portion 241 is located behind the first stopping portion 1411. The top wall 21 and the bottom wall 22 have the same structure and are provided symmetrically. The bottom wall 22 has a first stopping sheet 221 extending into the insertion opening 25, and the top wall 21 has a second stopping sheet 211 extending into the insertion opening 25. The first contact portion 231 is located closed to the second side wall 24 relatively than the first stopping sheet 221 and the second stopping sheet 211, and the first stopping sheet 221 and the second stopping sheet 211 stop the first contact portion 231 from moving away from the second side wall 24. In a direction perpendicular to the first side wall 23, the bottom wall 22 has a first reinforcing portion 222, and the top wall 21 has a second reinforcing portion 212. The first reinforcing portion 222 and the second reinforcing portion 212 are located behind the insertion opening 25, and are attached to an inner wall surface of the terminal slot 14. The first reinforcing portion 222 has a first opening hole 2221, and the second reinforcing portion 212 has a second opening hole 2121. In addition, the bottom wall 22 further has a third position limiting portion 223, and the top wall 21 further has a fourth position limiting portion 213. The third position limiting portion 223 and the fourth position limiting portion 213 are respectively formed by bending the bottom wall 22 and the top wall 21 toward each other and are located behind the first reinforcing portion 222 and the second reinforcing portion 212. A projection of the third position limiting portion 223 and a projection of the fourth position limiting portion 213 in the front-rear direction are only partially overlapped with the second side wall 24. Meanwhile, each terminal 2 has an oblique section 26 behind the third position limiting portion 223 and the fourth position limiting portion 213. The oblique section 26 is accommodated in the accommodating area 16, and the height thereof is gradually reduced from front to rear. A second contact portion 27 is provided behind the rear end of each terminal 2, namely behind the oblique section 26. The second contact portion 27 is folded into a flat plate shape. In the present embodiment, the second contact portion 27 is a flat plate contact portion. The second contact portion 27 is accommodated in the insertion space 15. The two second contact portions 27 share the insertion space 15, and the second contact portions 27 are used to be electrically connected to the second mating connector 300. A projection of the first stopping sheet 221 and a projection of the second stopping sheet 211 in the front-rear direction are located between the projection of the first contact portion 231 and the projection of the second contact portion 27 in the front-rear direction.

Referring to FIG. 2 and FIG. 5, the insulating member 3 is partially accommodated in the accommodating area 16. The insulating member 3 has a base body 31 and the two grooves 311 provided on the base body 31. Meanwhile, the insulating member 3 has a pair of parallel extending arms 32 extending forward from the base body 31 out of the accommodating area 16, and two guide blocks 33 protruding forward from the base body 31. Each extending arm 32 abuts the horizontal section 162 and forms a gap 164 with the plastic reducing section 163. Each extending arm 32 has a third stopping portion 322 at the front end thereof and an engagement block 321 at a side thereof. The third stopping portion 322 stops the third position limiting portion 223 and the fourth position limiting portion 213, and the third stopping portion 322 is located behind the third position limiting portion 223 and the fourth position limiting portion 213. The engagement block 321 is located in the through hole 123 and engaged with the front end surface 161. Each guide block 33 has a guide chamfer 331. During installation of the insulating member 3, the guide chamfer 331 can guide the terminals 2 to smoothly penetrate through the grooves 311, each of the flat plate contact portions 27 penetrates through each of the grooves 311 and enters the insertion space 15, and after the insulating member 3 is installed, the guide chamfer 331 corresponds to the oblique section 26.

Figure 6:
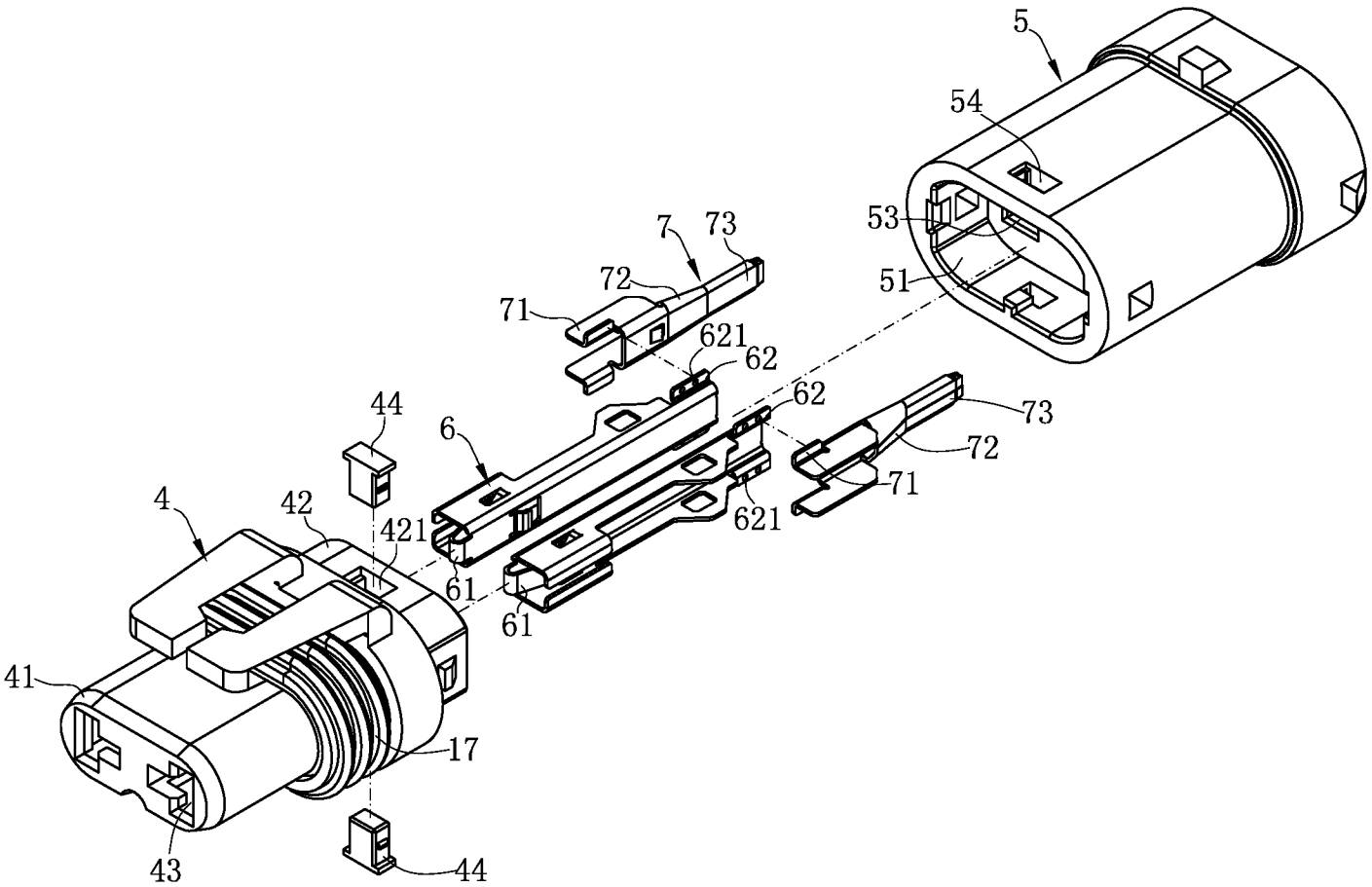
FIG. 6 is a perspective exploded view of an adapter connector according to a second embodiment of the present invention.
Figure 7:
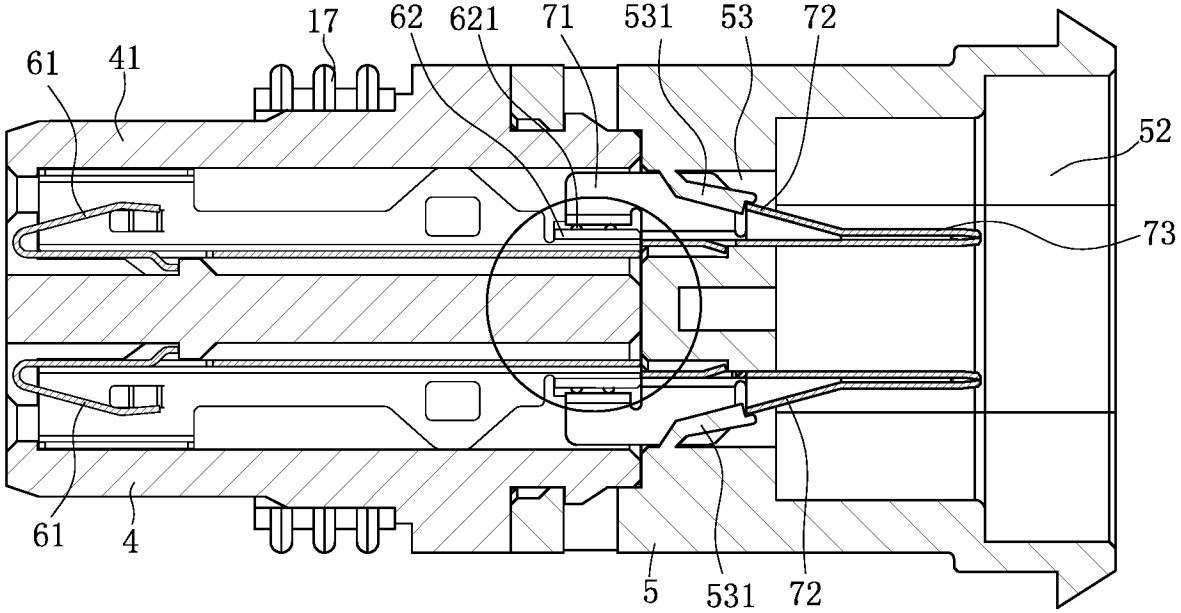
FIG. 7 is a sectional view of FIG. 6.
Figure 8:
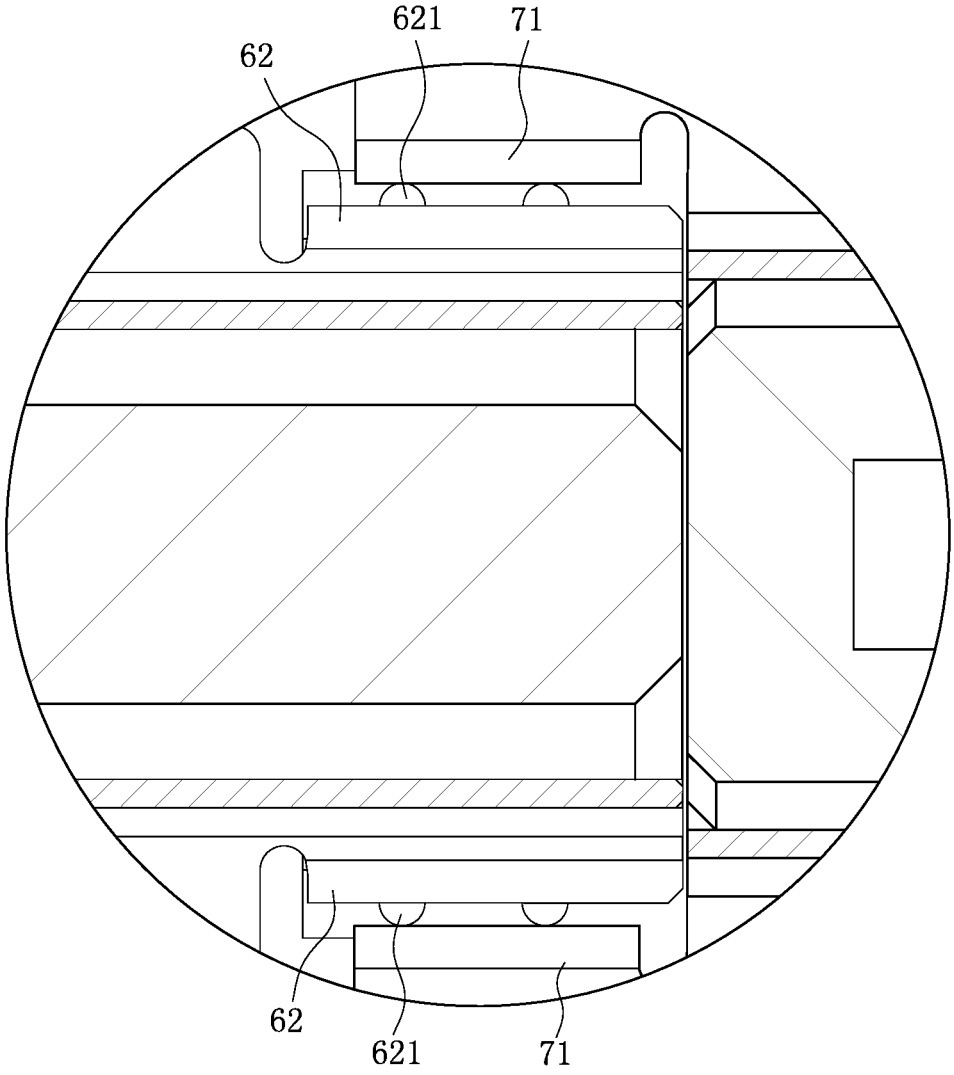
FIG. 8 is a partial enlarged view of FIG. 7.

Referring to FIG. 6 to FIG. 8, which show an adapter connector 100 according to a second embodiment of the present invention. The adapter connector 100 includes a first body 4, a second body 5, a first contact member 6 and a second contact member 7. The first body 4 has a first mating section 41 at the front end thereof and a protruding portion 42 at the rear end thereof. The first mating section 41 is used to be mated with the first mating connector 100. The protruding portion 42 is used to be mated with the second body 5. A waterproof ring 17 is sleeved over the first mating section 41. The first mating section 41 is concavely provided with two terminal slots 43. Each terminal slot 43 penetrates through the first mating section 41 and the protruding portion 42. An outer surface of the protruding portion 42 is concavely provided with two first fitting holes 421. The two fitting holes 421 are located on two opposite sides of the protruding portion 42 and communicated with the terminal slots 43. A front end of the second body 5 is backward concavely provided with an accommodating space 51, and a rear end of the second body 5 is forward concavely provided with an insertion space 52. Two terminal holes 53 communicating the accommodating space 51 and the insertion space 52 are provided therebetween. Meanwhile, an outer surface of the second body 5 is provided with two second fitting holes 54 opposite to each other. The accommodating space 51 is used to accommodate and cover the protruding portion 42. The insertion space 52 is used to accommodate the second mating connector 300. A fourth stopping portion 531 extends inward from an inner wall surface of each terminal hole 53. The second fitting holes 54 are communicated with the accommodating space 51. When the first body 4 is mated with the second body 5, two fixing blocks 44 penetrate through the first fitting holes 421 and the second fitting holes 54 to fix them. The first contact member 6 has a first contact portion 61 and a first connecting portion 62 which are connected with each other and provided sequentially in the front-rear direction. The first contact portion 61 and the structure between the first contact portion 61 and the first connecting portion 62 are the same as the terminal 2 of the first embodiment, and the difference exists in the structure of the first connecting portion 62. The first connecting portion 62 is formed by bending two opposite sides of the first contact member 6 outward. Each first connecting portion 62 has two protrusions 621 provided on the surface thereof. In other embodiments, there may be one or more protrusions. The second contact member 7 has a second connecting portion 71, a fifth position limiting portion 72 and a second contact portion 73 which are connected with each other and provided sequentially in the front-rear direction. The second connecting portion 71 is formed by bending two opposite sides of the second contact member 7 outward, and the second connecting portion 71 is accommodated in the accommodating space 51. When the first body 4 is mated with the second body 5, the second connecting portion 71 enters a corresponding terminal slot 43, and abuts and is electrically connected with the first connecting portion 62 via the protrusions 621. In the present embodiment, the protrusions 621 are provided on the first connecting portion 62, and in other embodiments, the protrusions 621 may be provided on the second connecting portion 71. The fifth position limiting portion 72 is located behind the fourth stopping portion 531 and is stopped by the fourth stopping portion 531. The structure and function of the second contact portion 73 are the same as those of the second contact portion 27 in the first embodiment.

Figure 9:
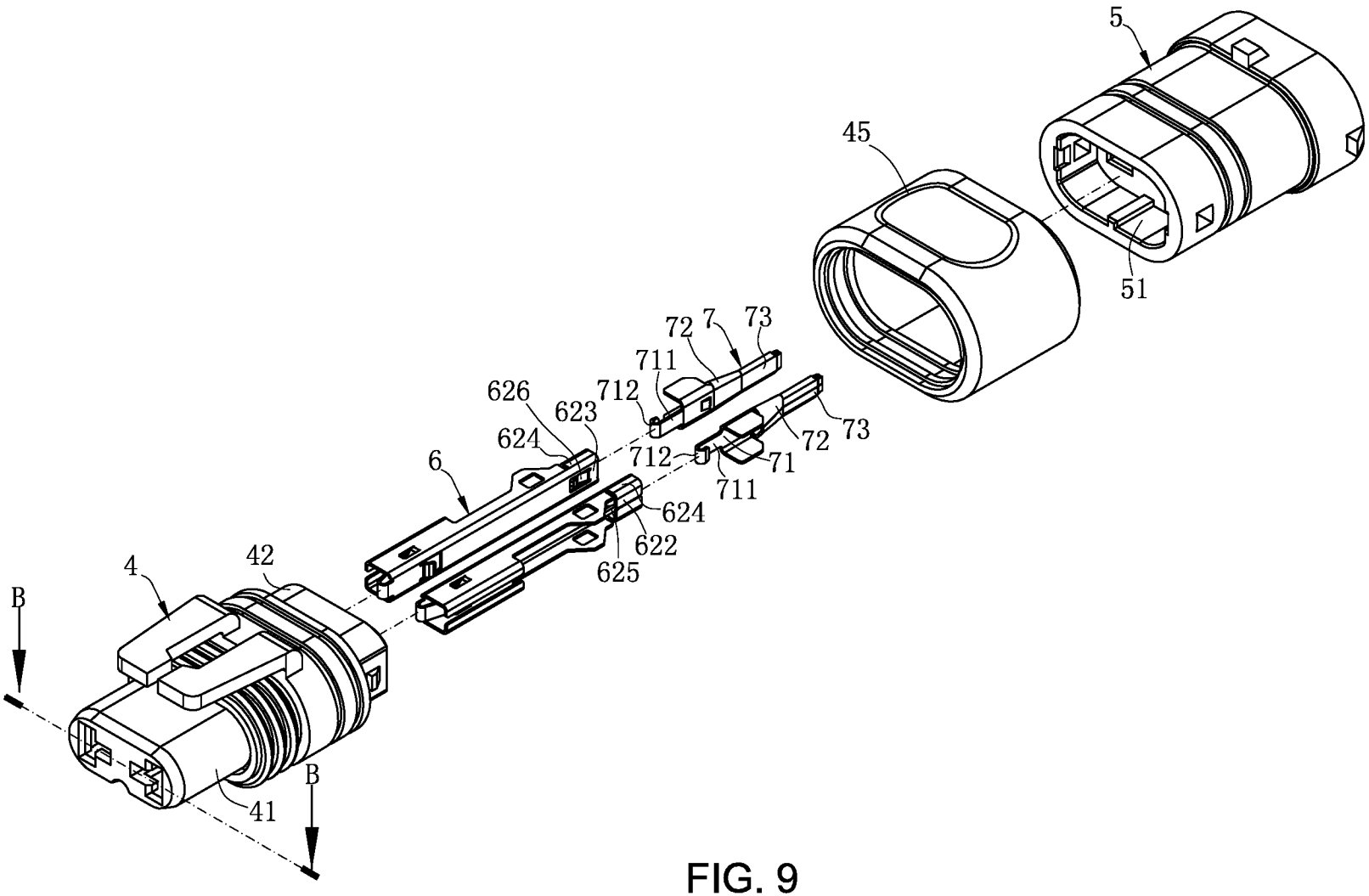
FIG. 9 is a perspective exploded view of an adapter connector according to a third embodiment of the present invention.
Figure 10:
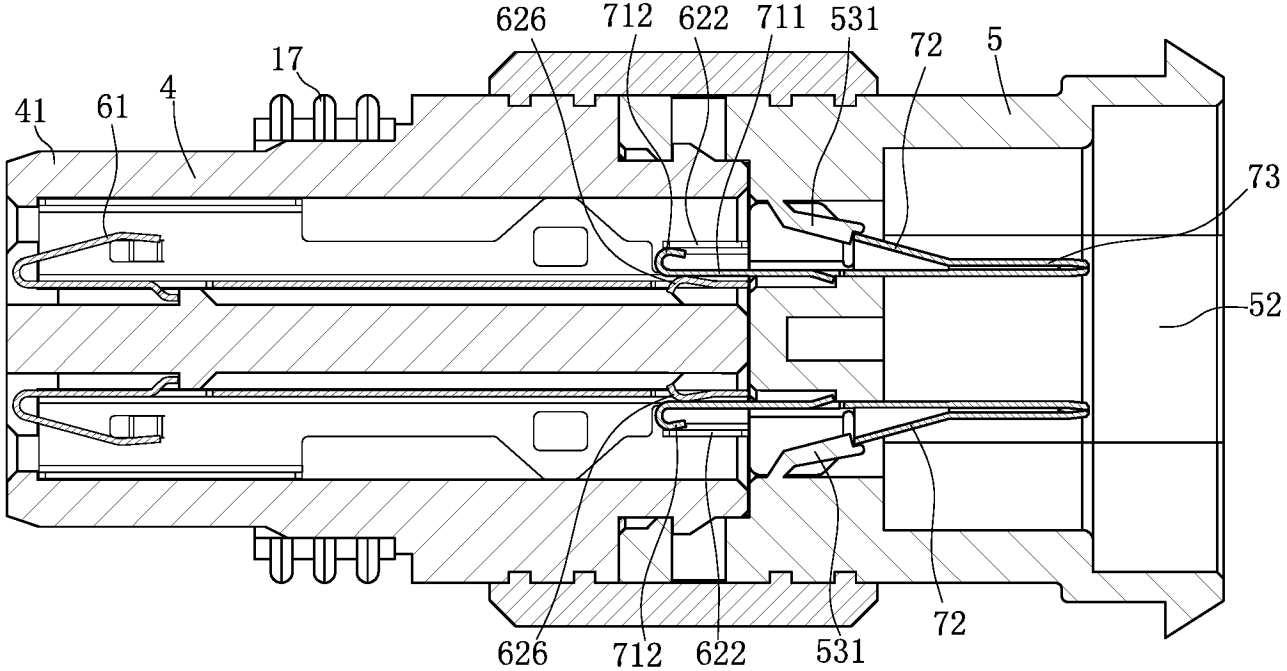
FIG. 10 is a sectional view of FIG. 9 along a B-B direction.

Referring to FIG. 9 and FIG. 10, which show an adapter connector 100 according to a third embodiment of the present invention is shown. A difference between the third embodiment and the second embodiment exists in that the first body 4 and the second body 5 are fixed via a fixing member 45 during mating. The fixing member 45 is injection-molded outside the first body 4 and the second body 5. Another difference exists in the structures of the first connecting portion 62 and the second connecting portion 71. The first connecting portion 62 has a first portion 622 and a second portion 623 opposite to each other, and two third portions 624 connected with the first portion 622. The first portion 622, the second portion 623 and the two third portions 624 form a receiving opening 625. An elastic resisting sheet 626 extends from the second portion 623 into the receiving opening 625. The second connecting portion 71 has a base 711 and a bending arm 712 extending forward from the base 711 and bending toward the base 711. In the present embodiment, the receiving opening 625 is located on the first contact member 6, and the bending arm 712 is located on the second contact member 7. In other embodiments, the bending arm 712 may be provided on the first contact member 6, and the receiving opening 625 may be provided on the second contact member 7. The base 711 abuts the elastic resisting sheet 626, and the bending arm 712 abuts the first portion 622, so as to implement an electrical connection between the first connecting portion 62 and the second connecting portion 71.

To sum up, the electrical adapter connector 100 according to certain embodiments of the present invention has the following beneficial effects:

1. Functionally, different series of headlights can be converted by the adapter connector 100, such that a series (e.g., 9006 series) of headlight plugs may easily match with another series (e.g., h11 series) of headlight receptacles, thereby providing an easy operation and saving time, and reducing the modification cost.

2. Structurally, each terminal 2 is integral in the first embodiment, which has a simple structure and a simple manufacturing procedure and saves time.

3. The first contact portion 231 is stopped by the first stopping sheet 221 and the second stopping sheet 211, such that when the adapter connector 100 is mated with the first mating connector 200, the first contact portion 231 cannot be damaged by excessive deformation.

4. The first reinforcing portion 222 and the second reinforcing portion 212 are provided on each of the terminals 2, such that the first reinforcing portion 222 and the second reinforcing portion 212 are attached to the inner wall surface of the terminal slot 14, and are unlikely to shake when the adapter connector 100 is mated with the first mating connector 200 and the second mating connector 300, thereby ensuring a steady contact. Meanwhile, the weight of each terminal 2 can be reduced by providing the first opening hole 2221 and the second opening hole 2121, thus meeting the light weight requirement of the terminals 2.

5. The first position limiting portion 241 is stopped by the first stopping portion 1411, such that the terminal 2 can be prevented from deviating forward when the second mating connector 300 is mated with the adapter connector 100, thereby ensuring a steady connection.

6. The second position limiting portion 232 is stopped by the second stopping portion 1421, the third position limiting portion 223 and the fourth position limiting portion 213 are stopped by the third stopping portion 322, and the engagement block 321 is engaged with the front end surface 161, such that the terminals 2 can be prevented from deviating backwards when the first mating connector 200 is mated with the adapter connector 100, thereby ensuring a steady connection.

7. The first connecting portion 62 is provided with the protrusions 621, and the first connecting portion 62 abuts the second connecting portion 71 via the protrusions 621, such that a steady contact between the first connecting portion 62 and the second connecting portion 71 can be ensured.

8. The base 711 abuts the elastic resisting sheet 626, and the bending arm 712 abuts the first portion 622, such that the second connecting portion 71 is in multi-point elastic contact with the first connecting portion 62, thereby implementing a steady electrical connection between the first connecting portion 62 and the second connecting portion 71.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An adapter connector having two ends configured to be mated with a first mating connector and a second mating connector respectively, the adapter connector comprising:

an insulating body being integrally formed, the insulating body having a first mating section and a second mating section in a front-rear direction, wherein the first mating section is concavely provided with a plurality of terminal slots, the second mating section is concavely provided with an insertion space, the terminal slots are communicated with the insertion space, the first mating section is mated with the first mating connector, and the insertion space accommodates the second mating connector; and a plurality of terminals, each of the terminals having an elastic contact portion at one end thereof and a flat plate contact portion at the other end thereof, wherein the elastic contact portion is accommodated in a corresponding one of the terminal slots and electrically connected with the first mating connector, and the flat plate contact portion is accommodated in the insertion space and configured to be electrically connected with the second mating connector;

wherein an intermediate portion is provided between the first mating section and the second mating section, the intermediate portion has at least one buckling arm extending from an outer surface of the intermediate portion to be above the first mating section and not to pass beyond a front end of the first mating section, an outer wall surface of the second mating section has at least one protruding block, and the first mating connector and the second mating connector are mated with the buckling arm and the protruding block respectively.

2. The adapter connector of claim 1, wherein a top wall and a bottom wall opposite to each other and a first side wall and a second side wall being connected with the top wall and opposite to each other are provided on each of the terminals, the top wall, the bottom wall, the first side wall and the second side wall surroundingly define an insertion opening, and the elastic contact portion of each of the terminals bends backward from the first side wall to extend into the insertion opening.

3. The adapter connector of claim 2, wherein the bottom wall has a first stopping sheet extending into the insertion opening, the top wall has a second stopping sheet extending into the insertion opening, the elastic contact portion is located closer to the second side wall relatively than the first stopping sheet and the second stopping sheet, and the first stopping sheet and the second stopping sheet stop the elastic contact portion from moving away from the second side wall.

4. The adapter connector of claim 3, wherein a projection of at least one of the first stopping sheet and the second stopping sheet in the front-rear direction is located between a projection of the elastic contact portion and a projection of the flat plate contact portion in the front-rear direction.

5. The adapter connector of claim 2, wherein each of the terminal slots has a first inner wall surface corresponding to the first side wall and a second inner wall surface corresponding to the second side wall, the first inner wall surface has a first stopping portion extending inward, the second inner wall surface has a second stopping portion extending inward, the second stopping portion is located behind the first stopping portion, the second side wall has a first position limiting portion, the first side wall has a second position limiting portion extending toward a direction away from the insertion opening, the first stopping portion is mated with the first position limiting portion, and the second stopping portion is mated with the second position limiting portion.

6. The adapter connector of claim 5, wherein the first stopping portion is located in front of the first position limiting portion, and the second stopping portion is located behind the second position limiting portion.

7. The adapter connector of claim 5, wherein an insulating member is accommodated in the insulating body, the insulating member has a third stopping portion, a third position limiting portion extends from the bottom wall, and the third stopping portion is mated with the third position limiting portion and located behind the third position limiting portion.

8. The adapter connector of claim 7, wherein a projection of the third position limiting portion and a projection of the second side wall are partially overlapped in the front-rear direction.

9. The adapter connector of claim 2, wherein the bottom wall has a first reinforcing portion located behind the insertion opening, and the first reinforcing portion further comprises a first opening hole.

10. The adapter connector of claim 1, wherein the insertion space is further provided with an accommodating area extending forward, an insulating member is accommodated in the accommodating area, each of two opposite sides of the insulating member is provided with an engagement block, the engagement block is engaged with a front end surface of the accommodating area, the insulating member is provided with a plurality of grooves corresponding to the terminal slots, and each of the flat plate contact portions penetrates through each of the grooves and enters the insertion space.

11. The adapter connector of claim 10, wherein each of the terminals further has an oblique section provided in front of the flat plate contact portion, and the insulating member has a plurality of guide chamfers corresponding to the oblique sections of the terminals, and each of the guide chamfers is in front of a corresponding one of the grooves.

12. The adapter connector of claim 10, wherein an inner surface of the accommodating area has a horizontal section and a plastic reducing section provided sequentially in the front-rear direction, and the insulating member abuts the horizontal section to form a gap between the insulating member and the plastic reducing section.

13. The adapter connector of claim 1, wherein each of the terminal slots accommodates a corresponding one of the terminals, and the insertion space accommodates the terminals.

14. An adapter connector having a front end and a rear end, the front end of the adapter connector being configured to be mated with a 9006 connector, and the rear end of the adapter connector being configured to be mated with an h11 connector, the adapter connector comprising:

an insulating body being provided with a first mating section and a second mating section in a front-rear direction, wherein the first mating section is concavely provided with a plurality of terminal slots, the second mating section is concavely provided with an insertion space, the terminal slots are communicated with the insertion space, the first mating section is mated with the 9006 connector, and the insertion space accommodates the h11 connector; and a plurality of terminals, each of the terminals being provided with a first contact portion at a front end thereof and a second contact portion at a rear end thereof, wherein the first contact portion is accommodated in a corresponding one of the terminal slots and electrically connected with the 9006 connector, and the second contact portion is accommodated in the insertion space and configured to be electrically connected with the h11 connector;

wherein an intermediate portion is provided between the first mating section and the second mating section, the intermediate portion has at least one buckling arm extending from an outer surface of the intermediate portion to be above the first mating section and not to pass beyond a front end of the first mating section, an outer wall surface of the second mating section has at least one protruding block, and the 9006 connector and the h11 connector are mated with the buckling arm and the protruding block respectively.

15. The adapter connector of claim 14, wherein a waterproof ring is sleeved over the first mating section, and the waterproof ring is located between the first mating section and the buckling arm.

16. An adapter connector, configured to be mated with a first mating connector and a second mating connector respectively, the adapter connector comprising:

a first body having a first mating section, wherein the first mating section is concavely provided with a plurality of terminal slots, and the first mating section is mated with the first mating connector;

a second body, wherein a front end of the second body covers a periphery of a rear end of the first body, and a rear end of the second body is forward concavely provided with an insertion space configured to accommodate the second mating connector; and a plurality of terminals, each of the terminals comprising a first contact member and a second contact member, wherein the first contact member is accommodated in a corresponding one of the terminal slots, the first contact member has a first contact portion and a first connecting portion connected with each other and provided sequentially in a front-rear direction, the first contact portion is electrically connected with the first mating connector, the second contact member has a second contact portion and a second connecting portion connected with each other, the second contact portion is accommodated in the insertion space, the second contact portion is electrically connected with the second mating connector, and the second connecting portion enters the corresponding one of the terminal slots and abuts the first connecting portion;

wherein the first connecting portion has a first portion and a second portion opposite to each other and two third portions connected with the first portion, the first portion and the two third portions surroundingly define a receiving opening, an elastic resisting sheet extends from the second portion into the receiving opening, the second connecting portion has a base and a bending arm extending forward from the base and bending reversely toward the base, the base abuts the elastic resisting sheet, and the bending arm abuts the top wall.

17. The adapter connector of claim 16, wherein a front end of the second body has an accommodating space communicated with the insertion space, and the second connecting portion and the rear end of the first body are accommodated in the accommodating space.

18. The adapter connector of claim 16, wherein at least one protrusion is provided on the first connecting portion or the second connecting portion, and the first connecting portion and the second connecting portion are electrically connected via the protrusion.

* * * * *